US006158442A

United States Patent [19]

Piatetsky

[11] Patent Number: 6,158,442

[45] Date of Patent: Dec. 12, 2000

[54] LIQUID RESERVOIR HAIRBRUSH WITH ABSORBENT FILLER AND ROLLER BALL LIQUID DISTRIBUTION MECHANISM

[76] Inventor: Andrey Piatetsky, 5702 Rhea Ave., Tarzana, Calif. 91356

[21] Appl. No.: 09/510,210

[22] Filed: Feb. 22, 2000

[51] Int. Cl.[7] ..... A45D 24/22

[52] U.S. Cl. ..... 132/115

[58] Field of Search ..... 132/111, 112, 132/113, 114, 115, 120, 320; 15/205.2; 401/28, 218, 208, 270, 272, 286, 287, 283

[56] References Cited

U.S. PATENT DOCUMENTS

| | | | |
|---|---|---|---|
| 819,444 | 5/1906 | Monroe | 132/212 |
| 1,425,269 | 8/1922 | Miller | 132/211 |
| 1,462,400 | 7/1923 | Warren | 15/397 |
| 2,519,740 | 8/1950 | Call | 401/195 |
| 4,055,195 | 10/1977 | Moses | 132/115 |
| 4,237,822 | 12/1980 | Kaiser, Jr. | 132/114 |
| 4,585,018 | 4/1986 | O'Connor | 132/120 |
| 4,867,183 | 9/1989 | Busch et al. | 132/110 |
| 5,291,905 | 3/1994 | Busch et al. | 132/116 |

*Primary Examiner*—Jeffrey A. Smith
*Assistant Examiner*—Eduardo C. Robert
*Attorney, Agent, or Firm*—Christie, Parker & Hale, LLP

[57] ABSTRACT

A liquid-reservoir hairbrush that is capable of dispersing water-based and other thin and non-viscous liquids over the user's scalp during routine hair combing or brushing. The brush bristles are preferably mounted to a flexible base. An absorbent filler is placed into a chamber of the brush body and absorbent feed rods are placed into bores of the brush bristles. The absorbent filler is preferably made from sufficiently spongy and/or springy material and covered by the flexible base. Liquid outlets (viz., nozzles) are mounted at distal ends of the brush bristles and have a roller ball liquid distribution mechanism, which functions such that the liquid will exit the nozzle when its roller ball makes a rolling contact with the user's scalp. The absorbent feed rods interconnect the absorbent filler and the roller balls mounted within the nozzles. The chamber of the brush body can be divided into multiple, hermetically isolated sections. The brush body can have an optional filler inlet and can come with an optional liquid refilling unit which can hold a predetermine volume of the liquid. The hairbrush comes with a removable bristle lid to keep the brush bristles enclosed when the hairbrush is not in use and prevent the roller balls from drying out.

9 Claims, 10 Drawing Sheets

LIQUID RESERVOIR HAIRBRUSH WITH ABSORBENT FILLER AND ROLLER BALL LIQUID DISTRIBUTION MECHANISM

FIELD OF THE INVENTION

The present invention relates to the liquid-reservoir hairbrushes particularly well-designed for dispersing low viscosity water-based solutions and other thin and non-viscous liquids over the user's scalp.

BACKGROUND OF THE INVENTION

Liquid-reservoir hairbrushes and combs have been available for years. In addition to combing and brushing, these devices allow a user to distribute water (and other thin and non-viscous liquids) and oil-based solutions over the user's hair and scalp. In some of these devices, liquid outlets (viz., nozzles) are mounted at distal ends of teeth or bristles. In other devices, the nozzles are located near proximal ends of the teeth or bristles (usually between them) or at a body of the hair device. Various attempts have been made to provide the combs and brushes for dispersing liquids over the user's scalp. However, these prior art devices have a variety of shortcomings.

For example, if the nozzle is located at a bristle area of the body of the brush (e.g. U.S. Pat. No. 5,927,290 to Thiruppathi) or between the comb teeth (e.g. U.S. Pat. No. 3,964,501 to Matchett), the liquid dispensed from the nozzle initially deposits on the user's hair and wets the hair and only thereafter contacts the user's scalp. This can makes the user's hair excessively wet and uncomfortable.

Moreover, because a diameter of the nozzle is much smaller than a size of a liquid reservoir, different types of pumps are used to force liquid flow through the nozzle. Accordingly, a person using this type of device has to adjust the liquid flow dispensed through the nozzle by operating different types of control mechanisms (e.g. U.S. Pat. No. 3,721,250 to Walter and U.S. Pat. No. 5,927,290 to Thiruppathi). Since the user usually has to perform the above procedure during hair brushing or combing, the prior art liquid-reservoir hairbrushes and combs with pumps are relatively complicated to operate.

Furthermore, there are other problems associated with the dispersion of water-based solutions and other thin and non-viscous liquids over the user's scalp for the devices with pumps. If the nozzles are mounted within the ends of the brush bristles or comb teeth (e.g. U.S. Pat. No. 3,101,086 to Di Vito), it would appear to be troublesome to control the liquid flow through the nozzles. Since most of the above devices have open-end teeth or bristles, the liquid will come out from the nozzles whether or not there is a contact with the user's scalp. Because all brush bristles or comb teeth cannot entirely contact the user's scalp simultaneously, the excessive liquid disperses between the user's hair and makes them wet. Others have attempted to devise ways to work around this problem. For example, U.S. Pat. No. 4,055,195 to Moses discloses a fluid-reservoir hair comb with roller balls mounted within the end of each comb tooth. Although the roller ball installed within the nozzle can partially control a high viscosity liquid flow of the oil-based solutions dispensed from the particular nozzle, the Moses construction is absolutely not acceptable for the low viscosity water-based solutions and other thin and non-viscous liquids. A well-known effect (previously described for ballpoint pens) of natural outflow of liquid through a gap between the roller ball and an internal wall of the roller ball seat, a so-called direct-flow phenomenon, in which air flows in through the gap to allow the liquid to flow out from the liquid reservoir, is liable to take place. Even more, there are another two potential problems for the users of the Moses device. First, the Moses reference notes that the roller ball installed within the nozzle of the comb tooth can release the liquid only upon moving contact of the roller ball with the user's scalp. Since, the human head is curved, just a few comb teeth usually contact the user's scalp with each pass of the comb through the person's hair. Therefore, it is very likely that the user of the Moses device will not be able to evenly dispense a sufficient amount of the liquid over the scalp during routine hair combing. Second, because of the high viscosity of the oil-based solutions, the person using the Moses comb has to apply an additional abnormal pressure to the comb to be able move the roller balls inside of the nozzles while combing.

Thus, none of the prior hair combs and brushes are designed to effectively and efficiently disperse water-based solutions and other thin non-viscous liquids over the user's scalp. Accordingly, there is a need for a liquid reservoir hair device that is capable of delivering water-based and other thin and non-viscous liquids to a person's scalp during routine hair combing or brushing.

BRIEF DESCRIPTION OF THE INVENTION

It is a first object of the invention to provide a liquid-reservoir hairbrush that is capable of dispersing water-based solutions and other thin and non-viscous liquids over the user's scalp during routine hair combing or brushing.

The first object is achieved by locating an absorbent filler (viz., liquid absorbent) in a chamber of the brush body and absorbent feed rods in bores of the brush bristles. Liquid outlets (viz., nozzles) are mounted at distal ends of the brush bristles and provide a roller ball liquid distribution mechanism, by which roller balls are mounted within each nozzle for rotation movement to disperse the liquid over the user's scalp only during rolling contact of the roller ball with the user's scalp. The absorbent feed rods interconnect the absorbent filler and the roller balls, and the liquid from the absorbent filler is supplied in the direction of the roller balls, by means of the liquid passing through the absorbent feed rods to feed a surface of each roller ball.

It is another object of the invention to provide a hairbrush with bristles that are preferably mounted to a flexible base and with an absorbent filler being made from a sufficiently spongy and/or springy material. The absorbent filler is placed into a chamber of the brush body and covered by the flexible base. When the user brushes his or her hair, the brush bristles push on the flexible base and pressurize the absorbent filler and help to move the liquid from the absorbent filler down to the absorbent feed rods.

It is yet a further object of the invention to provide a hairbrush with a chamber divided into multiple, hermetically isolated sections. A purpose of the separation is to keep the hairbrush in an overall workable condition, even if some of the nozzles and/or the brush bristles leak and the liquid starts to drain or vaporize from the absorbent filler.

Another object of the invention is to provide a hairbrush with a body having an optional filler inlet, so that the user can refill the absorbent filler with the liquid while using an optional liquid refilling unit which can hold a predetermine volume of the liquid.

A further object is to provide a hairbrush with a removable bristle lid to keep the brush bristles enclosed when the hairbrush is not in use and to prevent the roller balls from drying out.

BRIEF DESCRIPTION OF THE DRAWINGS

The invention is set forth in greater detail, with reference to the drawings, but is not so limited.

DETAILED DESCRIPTION OF THE INVENTION

The major goal of the present invention is to provide a device that will allow a user to conveniently disperse water-based solutions and other thin and non-viscous liquids over the scalp during routine hair combing or brushing. Since the above device has to be convenient for frequent use any time of the day, liquid outlets (viz., nozzles) have to be mounted at distal ends of comb teeth or brush bristles to avoid making the user's hair excessively wet and uncomfortable.

One great advantage of the hairbrush or comb with the nozzles having a roller ball liquid distribution mechanism is that the liquid from each particular nozzle will be released only upon moving contact of the roller ball mounted within that nozzle with the user's scalp. Usually just a few comb teeth can contact the user's scalp with each pass of the comb through the person's hair. Thus, it will be very likely, that if the roller ball nozzles will be mounted at the ends of the comb teeth, the user of this type of comb will not be able to evenly disperse a sufficient amount of the liquid over the scalp during typical hair combing. Therefore, in order to provide a more efficient dispersion of liquid from the roller ball nozzles over the user's scalp a hairbrush construction is more preferable than a comb construction.

Two major methods can be used to prevent a natural outflow of the low viscosity water-based solutions and other thin and non-viscous liquids (viz., direct-flow phenomenon) from the roller ball nozzles mounted at the ends of the brush bristles.

Figure 12:
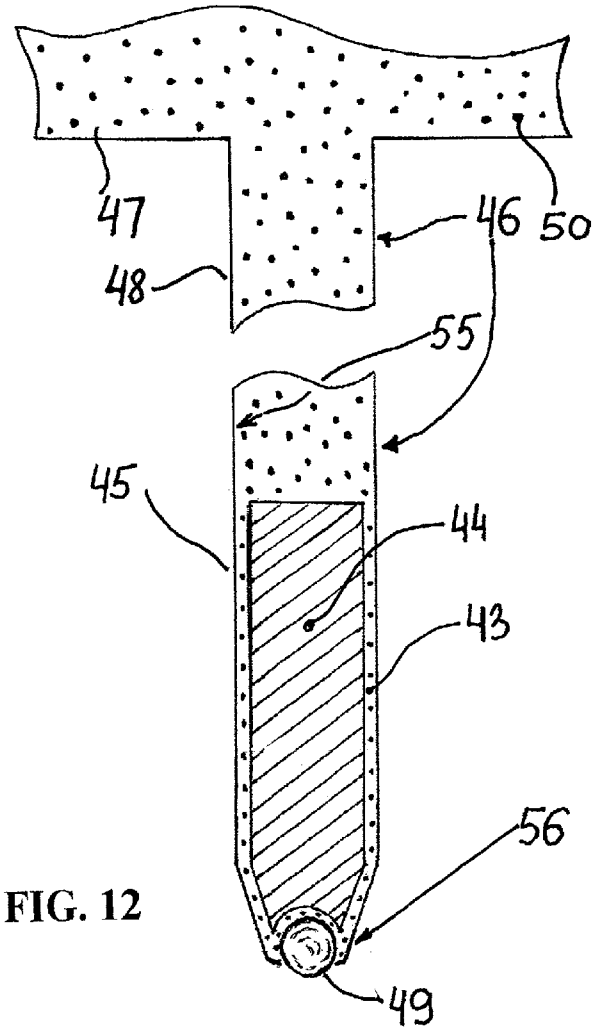
FIG. 12 is an explanatory drawing showing an alternative design when a capillary insert is installed into a distal end of the hairbrush bristle to prevent a natural outflow of low viscosity liquids from a roller ball nozzle.

First, a capillary action mechanism can be used in an optional design shown in FIG. 12, where a capillary space 43 is formed between an internal wall 55 of the brush bristle 46 and a capillary insert 44 installed into a distal end 45 of the brush bristle 46. The capillary space 43 is in communication with a liquid reservoir 47 through a proximal part 48 of the brush bristle 46; and with a roller ball 49 mounted within a nozzle 56 of the brush bristle 46. The capillary space 43 will be filled by liquid 50 from the proximal part 48 of the brush bristle 46 by a capillary action. The capillary action supplies the roller ball 49 with the liquid 50 from the capillary space 43. The capillary action will hold the liquid 50 in the capillary space 43 and prevent the natural outflow of the liquid 50 through the nozzle 56.

In a second, preferred design, shown in FIGS. 1–5, 9–10, an absorbent filler 6 can be employed to hold liquid in a liquid reservoir. Multiple absorbent feed rods 15 (one absorbent feed rod 15 per each brush bristle 12) can be used to transport the liquid from the absorbent filler 6 to roller balls 19 mounted within nozzles 16 of the brush bristles 12.

From a design standpoint there are two main reasons why the first noted capillary action mechanism is not ideal for use in liquid reservoir hair devices for dispersing water-based solutions and other thin and non-viscous liquids over the user's scalp. First, since the brush bristles are relatively flexible, it may prove to be difficult to design and manufacture a hairbrush where the capillary space 43 between the capillary insert 44 and the internal wall 55 of the brush bristle 46 will remain fixed and stable during hair brushing. Second, because the brush bristles are relatively thin, the capillary action will not be able to supply the roller ball with an appropriate amount of the liquid from the capillary space (viz., the user of the above device will not be able to disperse a sufficient amount of liquid over the scalp during hair brushing).

The brush construction permits the bristles to be mounted to a base that can be formed from a flexible material. Since pressure is applied to the brush bristles while brushing, the flexible base moves upwardly, thereby pressurizing the absorbent filler (if the absorbent filler is made from sufficiently spongy and/or springy material) and helps to move liquid from the absorbent filler down to the absorbent feed rods.

Thus, the following features are preferably combined in one device to accomplish convenient and sufficient dispersion of water-based solutions and other thin and non-viscous liquids over the user's scalp during routine hair combing or brushing:

(a) A hairbrush device has to have a liquid reservoir filed with an absorbent filler;

(b) The hairbrush device has to have at least two and preferably several rows of the brush bristles preferably mounted to a flexible base;

(c) Liquid outlets (viz., nozzles) have to be mounted at ends of the brush bristles;

(d) The nozzles have to have a roller ball liquid distribution mechanism; and (e) A combination of the absorbent filler with multiple absorbent feed rods has to be employed to prevent the direct-flow phenomenon and to transport the liquid from the absorbent filler to the nozzles mounted at the ends of the brush bristles.

Figure 7:
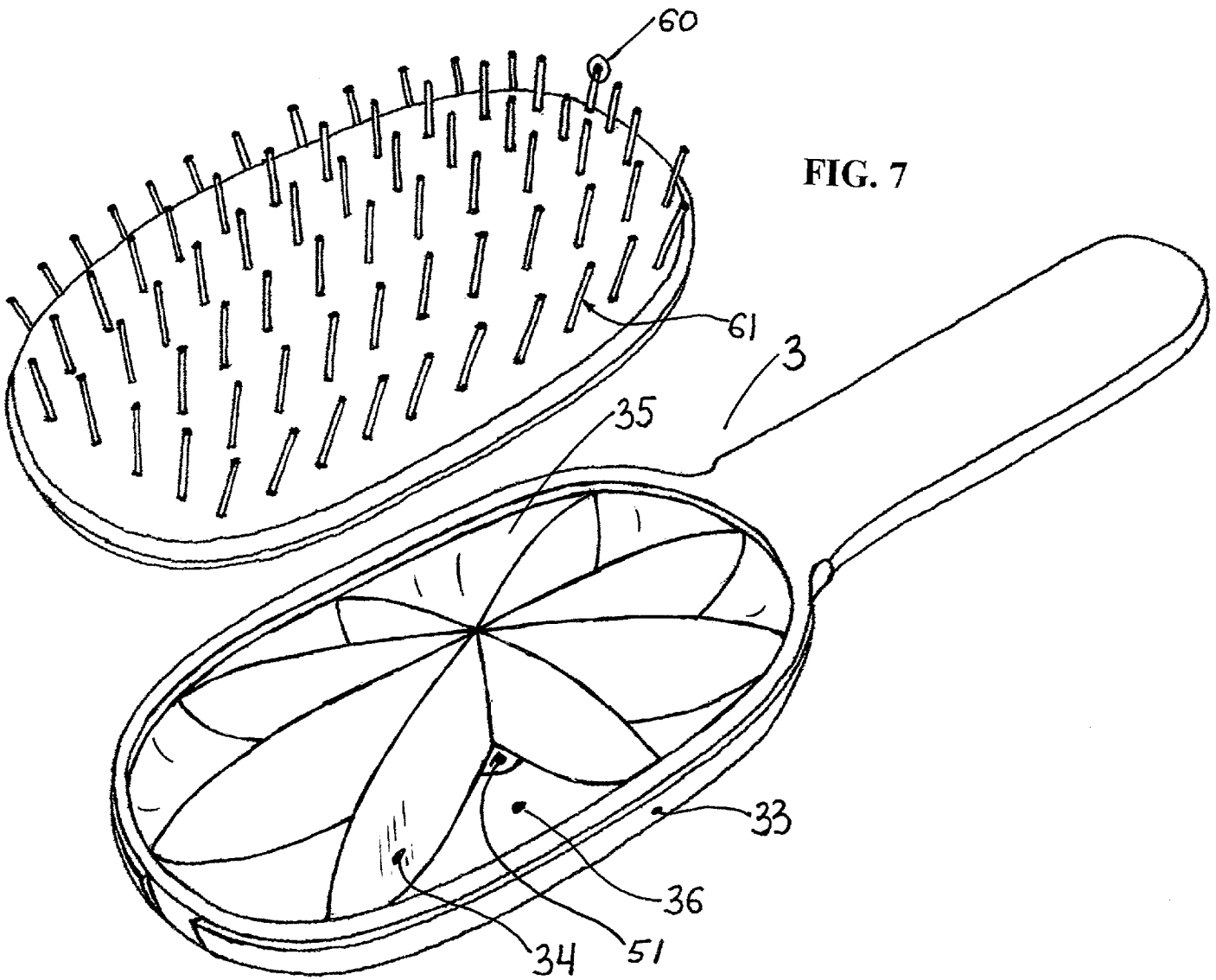
FIG. 7 is an exploded perspective view of a third embodiment of the hairbrush in accordance with the invention with a bristle frame removed to show a divider for an absorbent filler. The absorbent filler is not shown.
Figure 8:
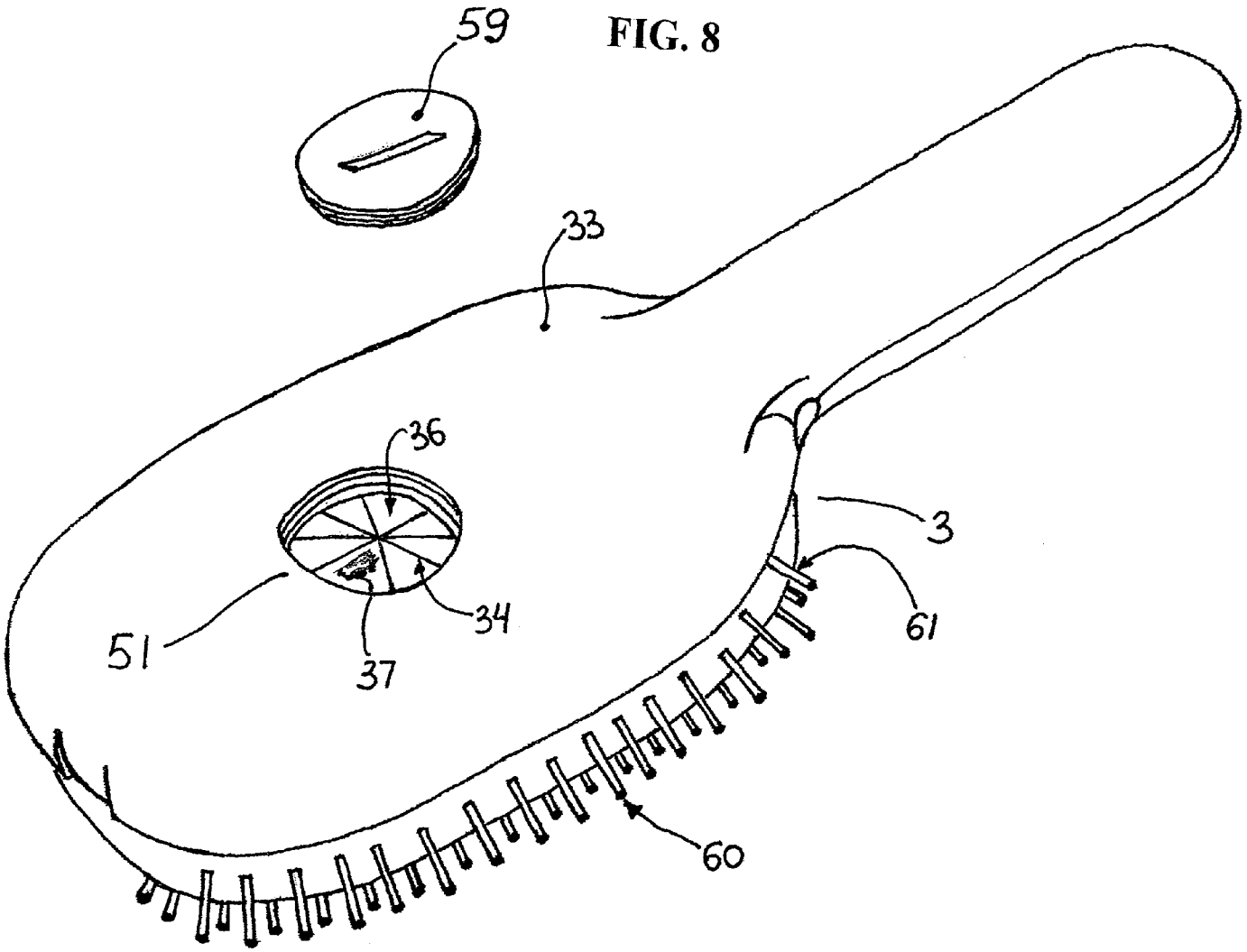
FIG. 8 is a perspective view of the hairbrush of FIG. 7 with a filler cap removed from a filler inlet to show the absorbent filler divider and the absorbent filler.
Figure 10:
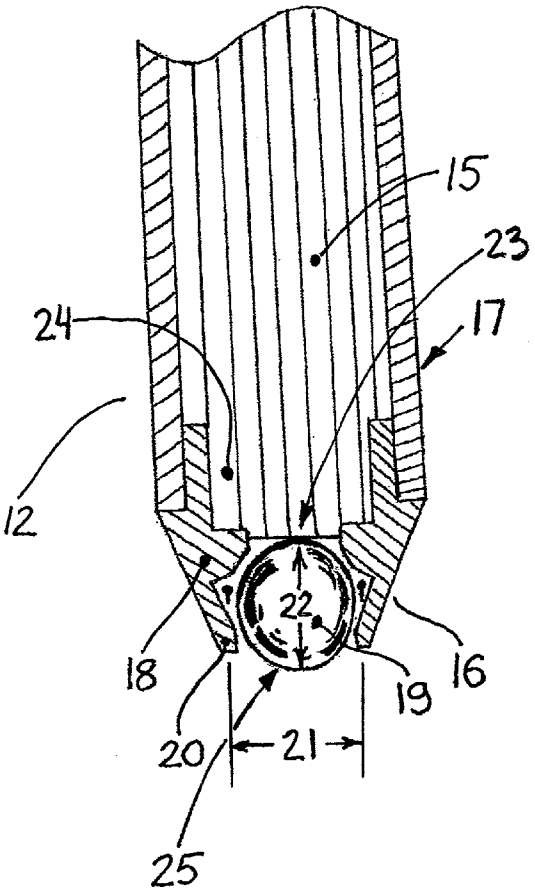
FIG. 10 is a cross-sectional view of a distal end of the hairbrush bristle in accordance with the invention showing a roller ball nozzle and a distal end of the absorbent feed rod.
Figure 9:
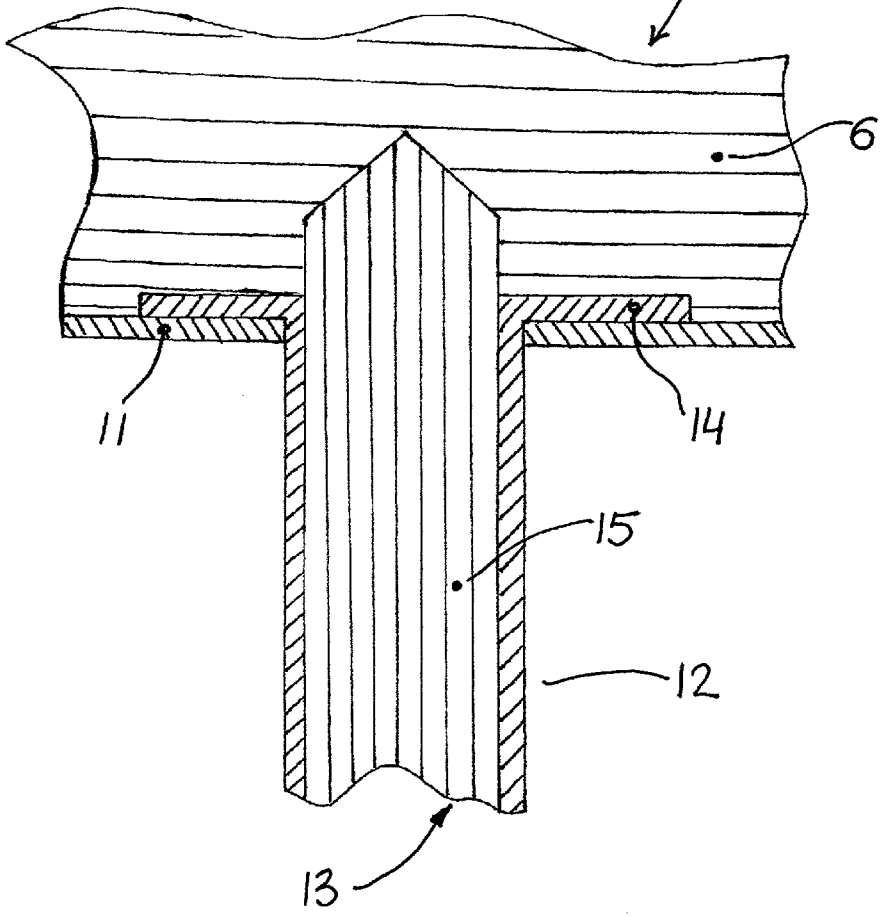
FIG. 9 is a cross-sectional view of a proximal end of the hairbrush bristle in accordance with the invention showing a connection between the absorbent filler and an absorbent feed rod.

Three different embodiments of the hairbrush of the invention are presented. A first embodiment (FIGS. 1–5) is shown in general as 1. A second embodiment (FIG. 6) is shown in general as 2. A third embodiment (FIGS. 7–8) is shown in general as 3.

Referring to the first embodiment (FIGS. 1–5), a hairbrush 1 has a body 4, a handle 5 and a bristle lid 26. The body 4 has a chamber 58, an absorbent filler 6, a brush frame 7 and a bristle frame 8. The bristle lid 26 has a catch clip 9 and two holders 10 which engage with the brush body 4 near the handle 5 to permit detachable engagement of the bristle lid 6 with the body 4 of the hairbrush 1. The bristle frame 8 has a flexible base 11 with a plurality of bristles 12. All of the above brush parts are preferably made from plastic, but can also be made from other known materials. The flexible base 11 is preferably made from a flexible material, such as rubber or plastic. The absorbent filler 6 is placed into the chamber 58 and covered by the bristle frame 8. The bristle frame 8 is preferably hermetically attached (e.g. by adhesives, welding, etc.) to the brush frame 7. The plurality of the bristles 12 extend outwardly from the flexible base 11 held in the bristle frame 8. The flexible base 11 is preferably hermetically attached to the bristle frame 8 (e.g. by adhesives, welding, etc.). Each bristle 12 (FIGS. 9–10) has a bore 13, a bristle ring 14, an absorbent feed rood 15 and a nozzle 16. Each bristle 12 is preferably hermetically attached (e.g. by adhesives, welding, etc.) to the flexible base 11 by inserting the bristle ring 14 into the flexible base 11. The nozzle 16 is mounted at a distal end 17 of the bristle 12. The bore 13 is fully filled by the absorbent feed rod 15 and the absorbent feed rod 15 extends into the brush body 4 and into the absorbent filler 6 and contacts with the absorbent filler 6. The absorbent filler 6 can be formed from a mass or bundles of fibers with a preferable porosity of about 60%, although other porosities will also function. The absorbent filler 6 is preferably made from sufficiently spongy and/or springy material. The size of the absorbent filler 6 may preferably be between 80 and 120 $cm^3$, so the total amount of the liquid which can be retained by the absorbent filler 6 will be approximately between 48 and 72 ml, however other sizes can be provided as well. The absorbent feed rod 15 can be formed from a bundle of resin-bonded fibers, however other known material can be used as well. A diameter of the absorbent feed rod 15 may preferably be between 1 and 2.5 mm, however other sizes can be provided as well.

Referring back to FIG. 10, the nozzle 16 is mounted at the distal end 17 of the bristle 12 and comprises a roller ball seat 18 and a roller ball 19. The roller ball seat 18 has a rim structure 20 to retain the roller ball 19 within the roller ball seat 18. The roller ball 19 and the roller ball seat 18 can be made from stainless steel or other known materials. An internal diameter 21 of the roller ball seat 18 is preferably 0.075–0.15 mm larger than a diameter 22 of the roller ball 19, however other size difference can be provided as well. The diameter 22 of the roller ball 19 is preferably between 1.5–2.5 mm, however other sizes can be provided as well. An axial hole 23 is formed through the roller ball seat 18, and a distal end 24 of the absorbent feed rod 15 extends inwardly into the axial hole 23 and contacts with the roller ball 19 for supplying the liquid to a surface 25 of the roller ball 19. The absorbent feed rod 15 interconnects the absorbent filler 6 and the roller ball 19. The liquid from the absorbent filler 6 is supplied in the direction of the roller ball 19 by means of the liquid passing through the absorbent feed rod 15 to feed the surface 25 of each roller ball 19. Each roller ball 19 is mounted within the roller ball seat 18 for rotation movement to transfer the liquid from the distal end 24 of the absorbent feed rod 15 to the user's scalp only upon rotation contact of the roller ball 19 with the user's scalp. Since the bristles 12 are connected to the flexible base 11, when the user brushes his or her hair, the flexible base 11 moves upwardly, thereby pressurizing the absorbent filler 6 and helps to move the liquid from the absorbent filler 6 down to the absorbent feed rods 15. The bristle lid 26 is provided to keep the brush bristles 12 enclosed when the hairbrush 1 is not in use and helps prevent the roller balls 19 from drying out. The bristle lid 26 is conveniently removably mounted to the brush body 4 by the catch clip 9 and two holders 10.

Figure 1:
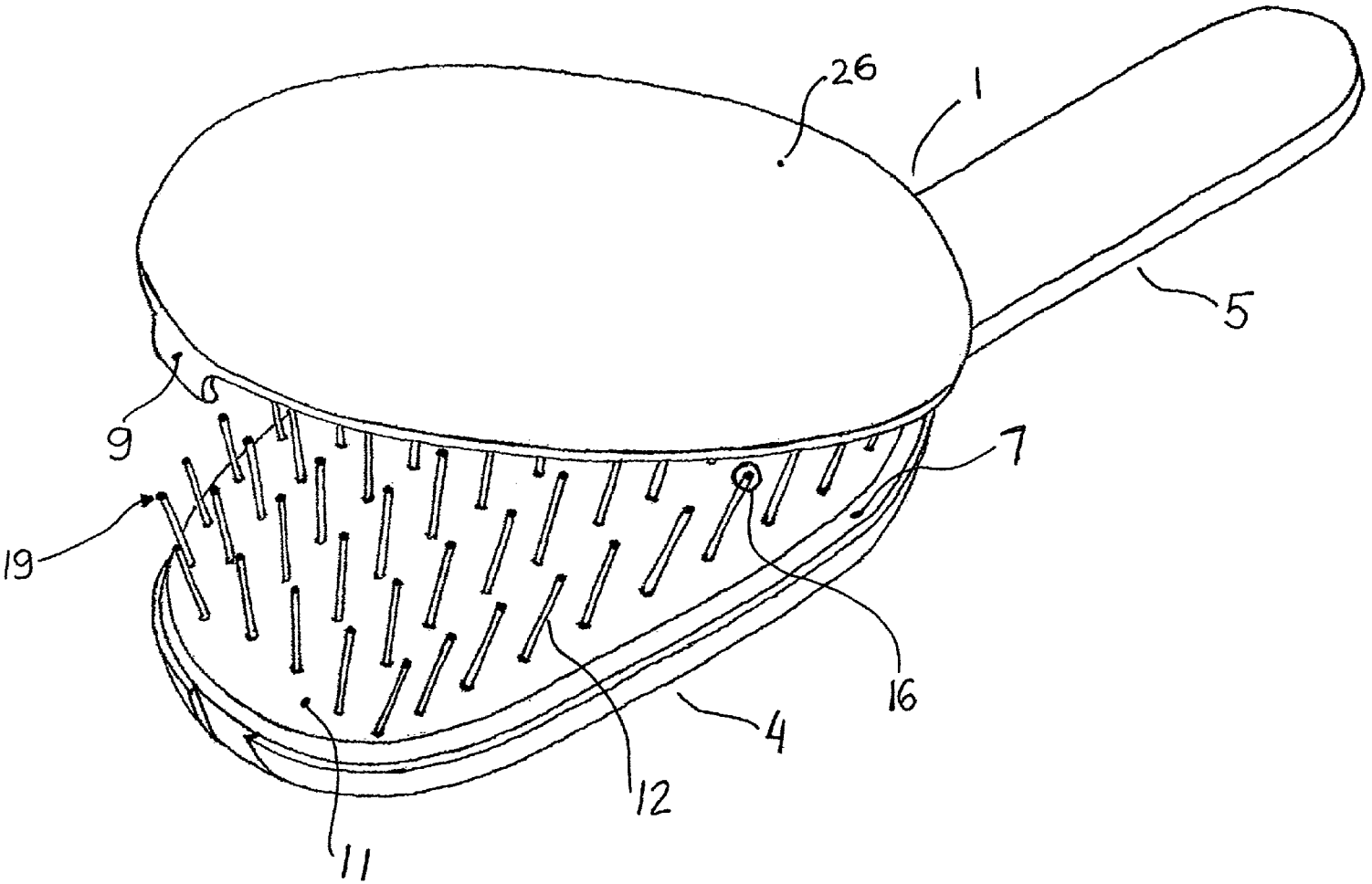
FIG. 1 is a perspective view of a first embodiment of the hairbrush in accordance with the invention. A bristle lid is partially open and bristle area is shown.
Figure 2:
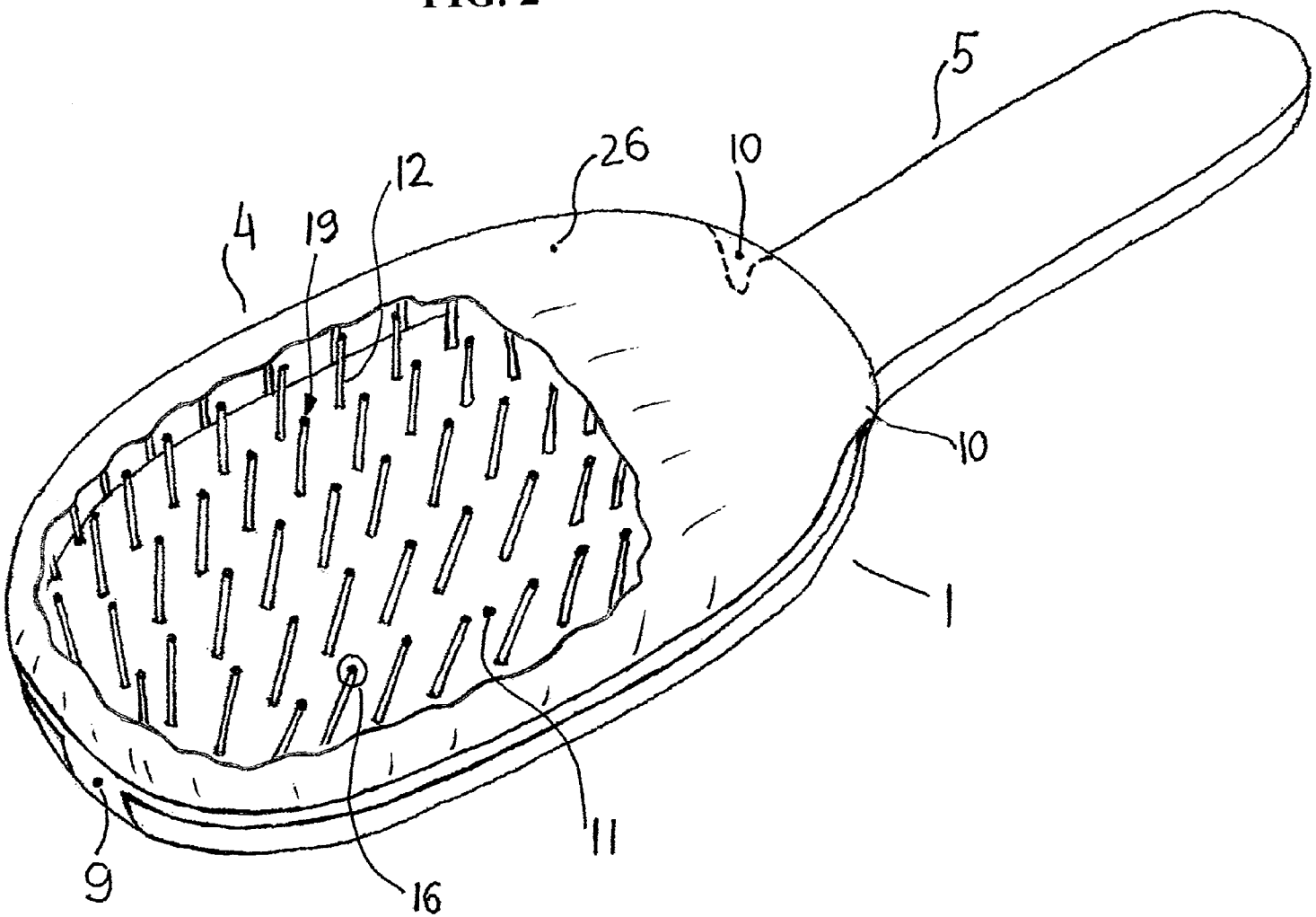
FIG. 2 is a perspective view of the hairbrush of FIG. 1 with the bristle lid closed and partially exposed to show the brush bristle area.
Figure 3:
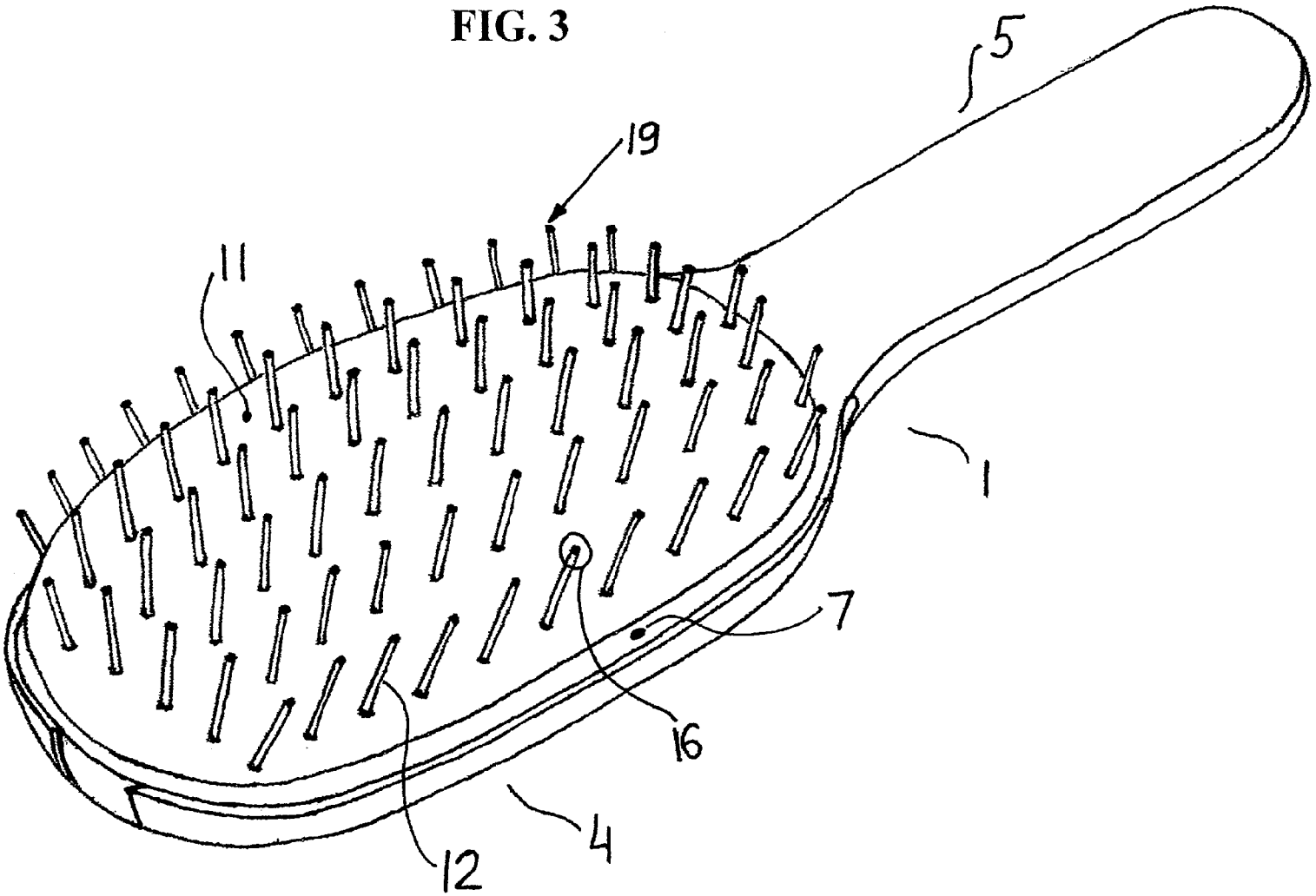
FIG. 3 is a perspective view of the hairbrush of FIG. 1 shown without the bristle lid.
Figure 4:
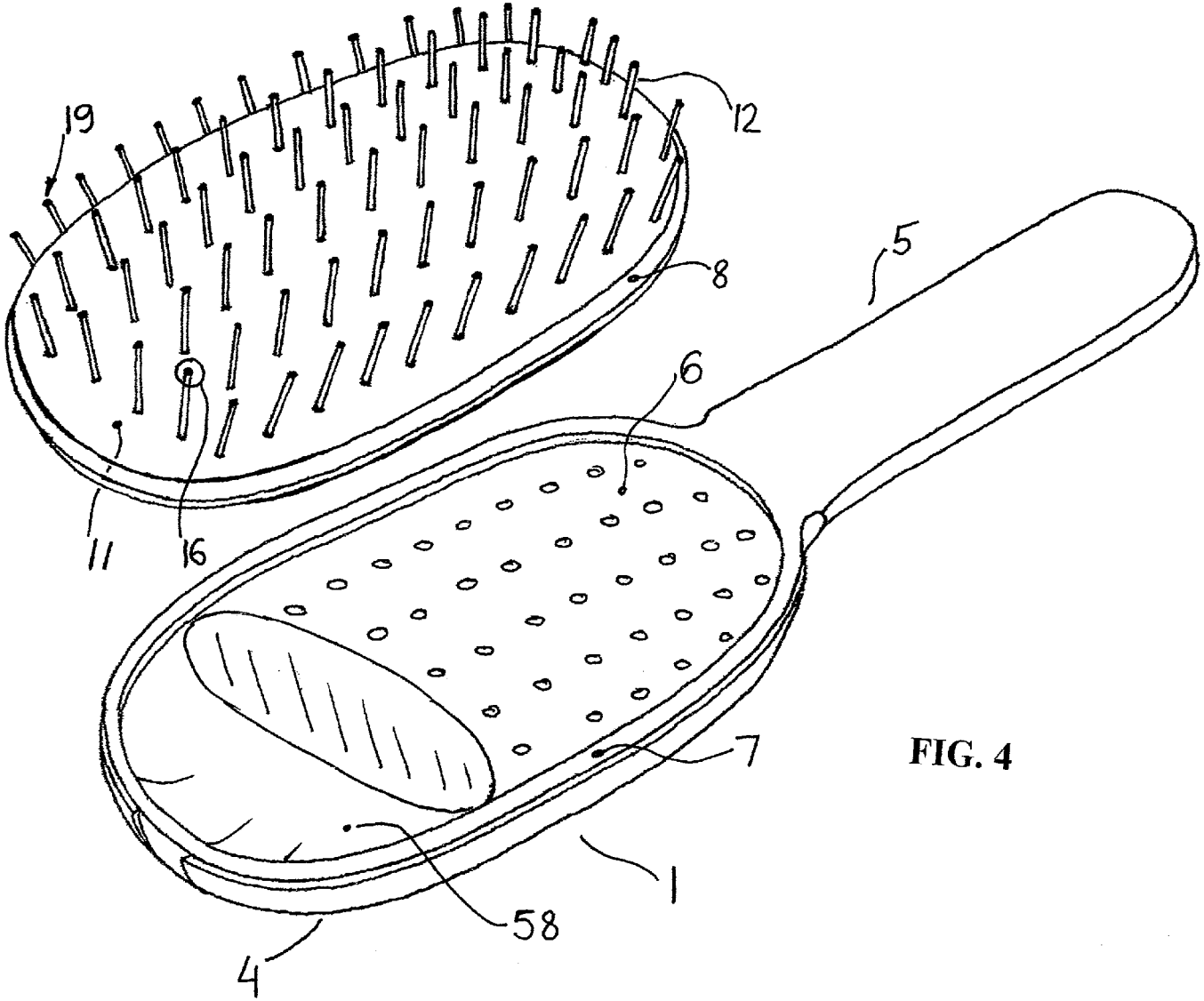
FIG. 4 is an exploded perspective view of the hairbrush of FIG. 1 with a bristle frame removed to show a partially exposed absorbent filler.
Figure 5:
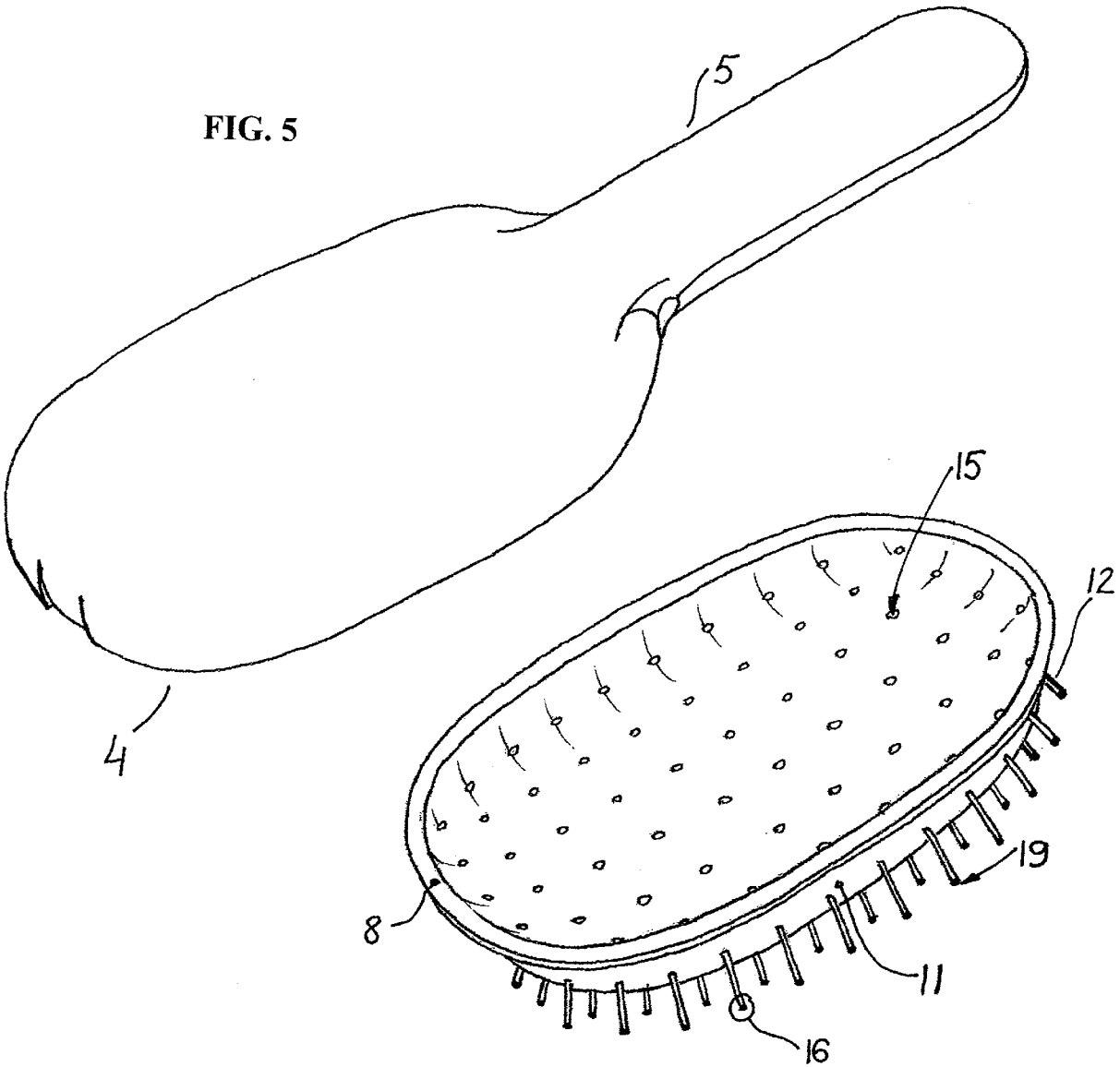
FIG. 5 is an exploded perspective view of the hairbrush of FIG. 1 with the bristle frame removed to show proximal ends of the bristle's bores.
Figure 6A:
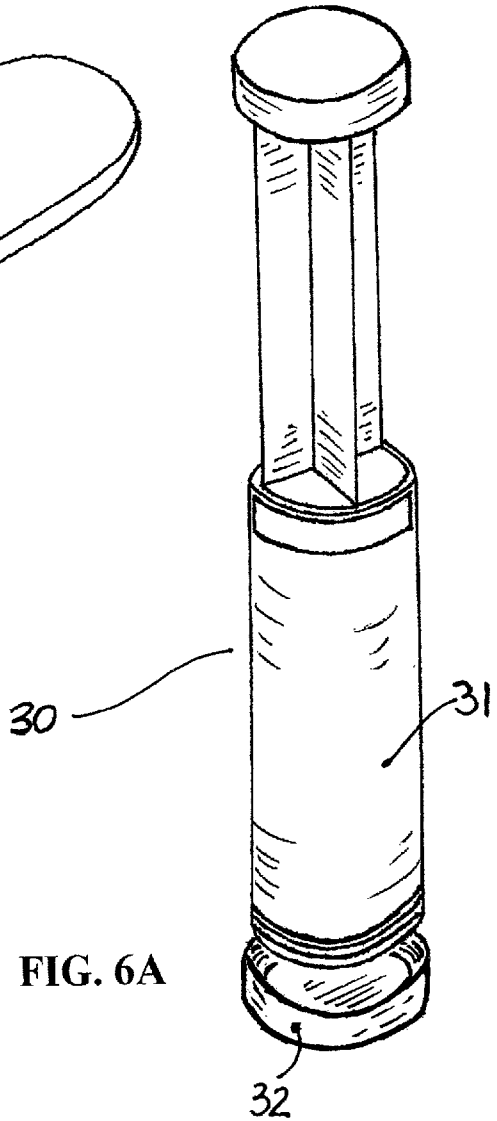
FIG. 6*a* is a perspective view of an optional liquid refilling unit.
Figure 6:
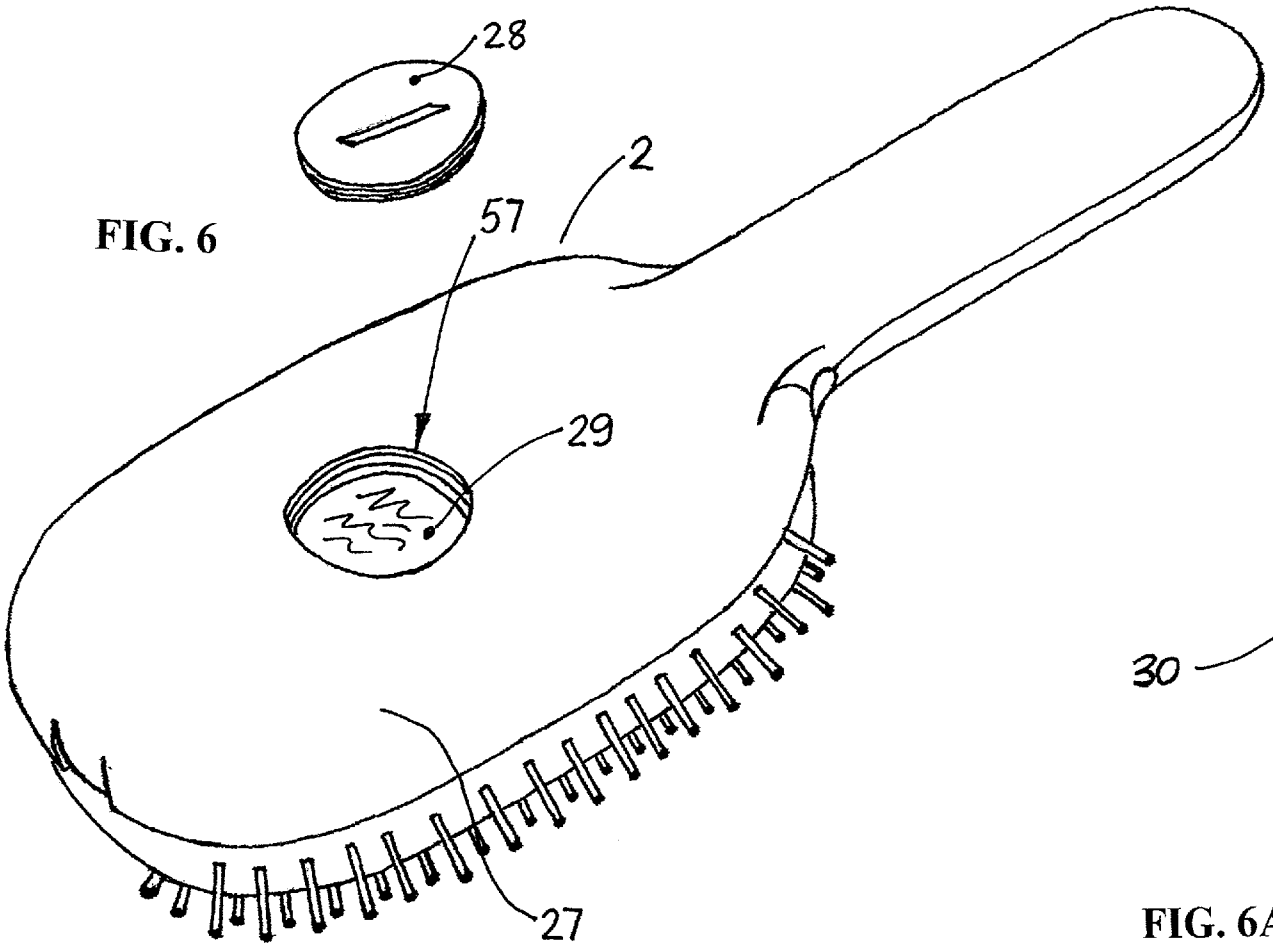
FIG. 6 is a perspective view of a second embodiment of the hairbrush in accordance with the invention. A filler cap is removed from a filler inlet and an absorbent filler is shown.

Referring to FIG. 6, the second embodiment of the hairbrush 2 is similar to the first embodiment, except that the brush body 27 has a filler inlet 57 and a filler cap 28, so the user can refill the absorbent filler 29 while using an optional liquid refilling unit 30 (FIG. 6*a*). The liquid refilling unit 30 has a syringe construction and can hold a predetermine volume of the liquid depending on the particular design of the hairbrush 2 and the liquid capacity of the absorbent filler 29. The liquid refilling unit 30 is preferably made from a plastic material and has a body 31 and a cap 32. The liquid refilling unit 30 can be pre-filled with the liquid.

The third embodiment of the hairbrush 3 (Please see FIGS. 7–8) is similar to the second embodiment, except that a brush body 33 has an absorbent filler divider 34 which separates a chamber 35 into multiple (e.g. eight) sections 36. The absorbent filler divider 34 is preferably made from the same material as a brush body 33. An absorbent filler 37 is placed into each section 36, and when a filler inlet 51 is closed by a filler cap 59, the above sections 36 are preferably hermetically isolated from one another. A purpose of the absorbent filler divider 34 is to keep the hairbrush 3 in an overall workable condition, even if some of nozzles 60 and/or bristles 61 leak and the liquid starts to drain or vaporize from the absorbent filler 37.

Figure 11:
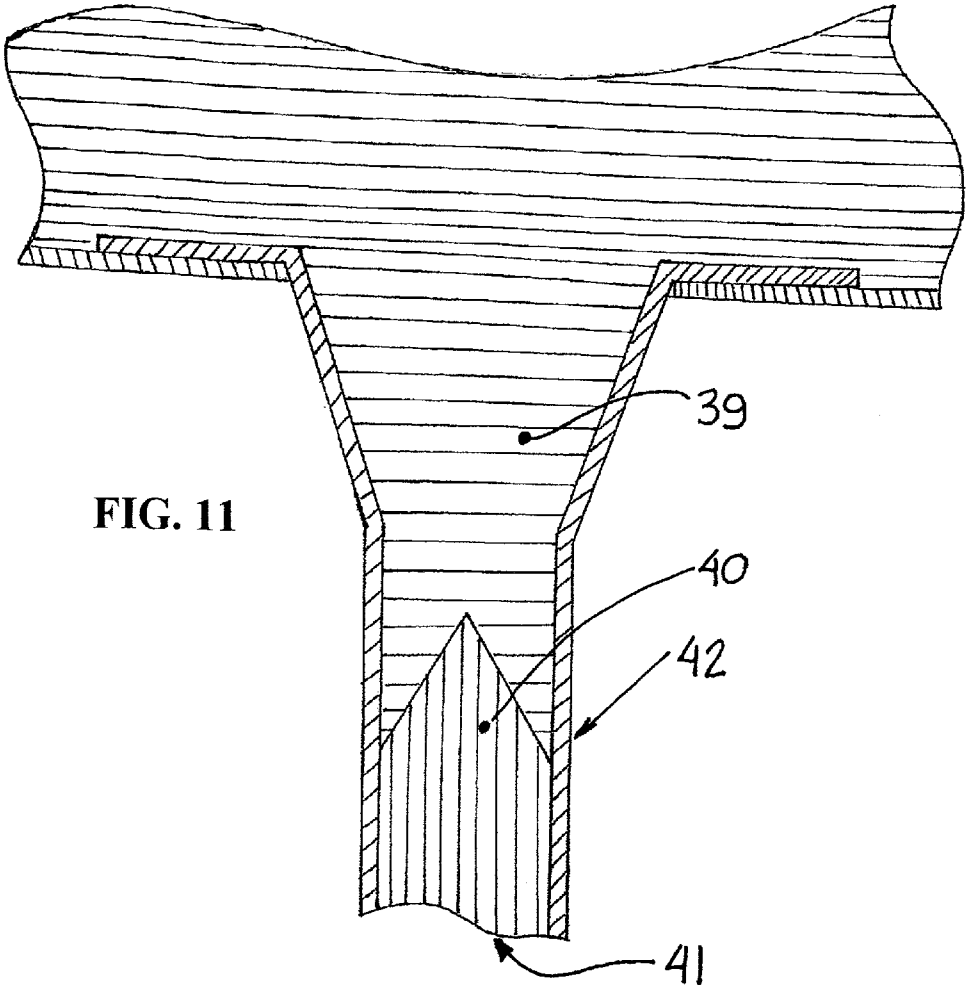
FIG. 11 is a cross-sectional view of a proximal end of a hairbrush bristle in accordance with the invention showing an alternative connection between an absorbent filler and an absorbent feed rod, wherein the absorbent filler partially extends into the bristle's bores.

Referring back to all three embodiments of the present invention, an alternative type of connection between an absorbent filler and absorbent feed rods can be provided, wherein the absorbent filler partially extends into the bristle's bores. The above connection is shown in FIG. 11, where an absorbent filler 39 partially extends into a bore 41 of a bristle 42 and contacts with an absorbent feed rod 40.

The aforementioned three embodiments of the hairbrush of the present invention are relatively inexpensive to produce and can provide a convenient and efficient brush device to disperse low viscosity water-based solutions and other thin and non-viscous liquids over the user's scalp during routine hair brushing.

I claim:

1. A liquid-reservoir hairbrush adapted for dispersing water-based solutions and other thin and non-viscous liquids over a user's scalp during hair brushing, comprising:

(a) a brush body having a chamber;

(b) at least one absorbent filler adapted to store liquid and placed into the chamber; and (c) a plurality of brush bristles, each having a proximal end and a distal end, not all of which are in a straight line, the brush bristles being mounted in the vicinity of their proximal ends to the brush body, wherein each brush bristle comprises;

an elongate body with bore formed therethrough, a nozzle mounted at the distal end of each brush bristle comprising a rotatably mounted roller ball, and at least one absorbent feed rod placed in the bore, wherein the absorbent feed rod interconnects the absorbent filler and the roller ball, and wherein the liquid will exit the nozzle when its roller ball makes rolling contact with the user's scalp.

2. The hairbrush of claim 1, further comprising a flexible base mounted to the brush body, wherein the brush bristles are mounted to the flexible base.

3. The hairbrush of claim 1, further comprising a bristle lid to keep the brush bristles enclosed when the hairbrush is not in use and to help prevent the roller balls from drying out.

4. The hairbrush of claim 1, wherein the chamber is divided into at least two separate sections, and wherein these sections are preferably hermetically isolated from one another, and wherein the absorbent filler is placed into each section.

5. The hairbrush of claim 1, wherein the brush body has a filler inlet to permit the user to refill the absorbent filler with liquid.

6. The hairbrush of claim 5, further comprising a liquid refilling unit that is adapted to place liquid in the absorbent filler when the filler inlet is opened.

7. The hairbrush of claim 6, wherein the liquid refilling unit is pre-filled with the liquid and is adapted to engage with the brush body when the filler inlet is opened.

8. The hairbrush of claim 1, wherein the absorbent feed rods of the brush bristles extend into the brush body and into the absorbent filler and contact with the absorbent filler.

9. The hairbrush of claim 1, wherein the absorbent filler partially extends into the bores of the brush bristles and contacts with the absorbent feed rods located therein.

* * * * *